US005667441A

United States Patent [19]

Parsons

[11] Patent Number: 5,667,441

[45] Date of Patent: Sep. 16, 1997

[54] CONCEALABLE EXPANDABLE BATON WITH KEY RING

[75] Inventor: Kevin L. Parsons, Appleton, Wis.

[73] Assignee: Armament Systems and Procedures, Inc., Appleton, Wis.

[21] Appl. No.: 600,318

[22] Filed: Feb. 13, 1996

Related U.S. Application Data

[63] Continuation of Ser. No. 385,180, Feb. 7, 1995, abandoned.

[51] Int. Cl.[6] ..... F41B 15/02

[52] U.S. Cl. ..... 463/47.7; 70/456 R; 70/459

[58] Field of Search ..... 273/84 R, 84 ES; 70/456 R, 457, 458, 459

[56] References Cited

U.S. PATENT DOCUMENTS

| | | | |
|---|---|---|---|
| 2,013,027 | 9/1935 | Branch | 70/456 R |
| 4,460,174 | 7/1984 | Perry | 70/456 R |
| 4,475,367 | 10/1984 | Raitto | 70/456 R |
| 4,687,131 | 8/1987 | von Braunhut | 273/84 R |
| 4,752,072 | 6/1988 | Parsons . | |
| 5,149,092 | 9/1992 | Parsons . | |
| 5,161,800 | 11/1992 | Parsons et al. | 70/456 R |
| 5,356,139 | 10/1994 | Parsons . | |
| 5,363,680 | 11/1994 | Wu | 70/459 |

*Primary Examiner*—William M. Pierce

*Attorney, Agent, or Firm*—Robert C. Curfiss; Mark A. Tidwell; Butler & Binion, L.L.P.

[57] ABSTRACT

A concealable, expandable baton having the appearance of a belt key ring is adapted to be concealed and carried in the waistband of undercover law enforcement personnel for use as an intermediate force weapon. The concealable baton includes a smooth handle and a detachable mechanism which may include a key ring and keys, and hangs over the waistband to prevent the concealed baton from falling into the clothing. The key ring and keys providing a readily accessible means for grasping and quickly drawing the baton.

13 Claims, 1 Drawing Sheet

12
10

16
15
14
18
22
30

24

20
28
26
16
29
4
4
24
14
18

28
29
34
27
26
48
16
42
31
44
43
36
40
38
46
32
50
24
49

CONCEALABLE EXPANDABLE BATON WITH KEY RING

This application is a continuation application of Ser. No. 08/385,180, filed Feb. 7, 1995, now abandoned.

BACKGROUND OF INVENTION

1. Field of the Invention

The subject invention is generally related to nightsticks, batons and intermediate force weapons and is specifically directed to concealable expandable baton with a key ring for use by undercover law enforcement personnel.

2. Description of the Prior Art

Nightsticks and batons are well known and have gained widespread acceptance as intermediate force weapons for use by law enforcement personnel. One of the best known intermediate force weapons is the ASP Expandable Baton manufactured by Armament Systems and Procedures, Appleton, Wis., the assignee of the subject application. Typically, the ASP Baton includes three telescoping sections, the largest section defining a handle adapted for receiving and nesting the remaining sections when the baton is in a collapsed position. In the collapsed position, the baton is approximately 8 to 10 inches long and can be carried by law enforcement personnel in a suitable sheath on the belt of the uniform. The baton is adapted to be drawn quickly from the sheath and opened in a swinging action for whipping the nested sections out to an extended position and locking them in position for use as an intermediate force weapon.

While the ASP Baton has greatly advanced the art relating to intermediate force weapons and is typically carried by law enforcement personnel, it is designed to be carried in a baton case which is visible on the officer and is not readily suitable for use by an undercover officer. In order to ensure the success of an undercover operation and safety of an officer, it is crucial that the identity of an undercover officer, such as a Drug Enforcement Agent (DEA) or the like, not be revealed. Thus, a DEA may not be able to carry a gun, a baton or other weapons, in certain situations, such as a drug bust, without risking exposure of his identity. Instead of entering a potentially dangerous situation with no weapon, a DEA may prefer to carry a well concealed weapon. While hand guns, knives and other weapons may be readily concealed, concealment is usually coupled with a loss of accessibility. There is a constant battle between concealment to remain undetected and accessibility for protection of the officer and apprehension of a suspect. The prior art weapons including intermediate weapons such as nightsticks and batons, do not generally provide for both good concealment and good accessibility.

While it is often desirable to carry an intermediate force weapon, it is extremely important to conceal the weapon so as not to reveal the identity of the agent. In the past, undercover agents have used ankle holsters or other means for concealing weapons. However, a weapon hidden in an ankle holster is not readily accessible since the agent must bend down and release the weapon from the holster before he is able to use it. Similarly, weapons hidden in pockets or inside the clothing of an undercover officer are typically difficult to quickly retrieve. Moreover, the ankle holster or bulging pocket may be visible and fail to effectively conceal the weapon and identity of the officer.

While self-defense keychains are available which could be conveniently carried without risking exposure of the DEA, such keychains typically are not designed to provide sufficient force for use in dangerous law enforcement situations. For example, the self-defense keychain shown in U.S. Pat. No. 4,752,072 is a reduced-size baton with one telescoping section and a grooved handle. While the telescoping section provides a keychain self-defense weapon which is longer than other prior art self-defense keychains, the self-defense keychain of U.S. Pat. No. 4,752,072 is only 8¾ inches in the extended position and does not provide the DEA with a full service, concealable baton.

Therefore, there is a need for a full size, lightweight, expandable baton which is totally concealed and easy to carry while being instantly accessible to the officer.

SUMMARY OF THE INVENTION

The subject invention is directed to a lightweight expandable baton with a non-identifying element such as a key ring which is adapted to be placed in the waistband allowing the non-identifying element of the baton to be exposed while the baton is totally concealed. For example, the presence of keys would not indicate the identity of a person as an undercover officer.

The baton of the subject invention is lightweight, easy to carry and has a smooth handle for ready placement in the waistband. Because the non-identifying element is adapted to hang over the belt or waistband of the clothing, the baton will not fall down the pants during various activities, such as running, stretching and the like making the baton readily accessible yet well concealed. By grasping the element, the baton is easily drawn from its concealed position and whipped into an extended position in one quick motion. In the preferred embodiment, the placement of keys at the waistband further conceals the weapon by giving the appearance of a belt key ring. Thus, while the subject invention serves and appears as a keychain or other non-descriptive item, it is a well concealed, yet readily accessible, expandable full size baton for use as an intermediate force weapon.

In the collapsed position, the baton is approximately 6 to 8 inches long and can be comfortably carried inside the waistband of the law enforcement officer. Because the baton is carried inside the waistband, no carrying case is necessary. The baton includes at least one telescoping section which is housed in the handle section of the baton in the collapsed position. In its extended position, the baton of the subject invention is a full size baton, at least 12 inches long, and preferably measuring from 16 to 21 inches. In the preferred embodiment, a swivel mechanism with a through hole is included at the end of the handle for attaching a key ring and keys to the baton. The handle includes an extended cap at the swivel end. The inclusion of an extended cap allows the swivel mechanism to rest flat in the baton and not project above the end of the cap when the detachable key ring is removed. When a key ring and keys are attached to the swivel mechanism, the keys of the baton hang over the belt in a non-conspicuous manner while anchoring the baton in place and providing a readily accessible handle for quickly retrieving the baton.

The expandable baton of the subject invention is adapted to be readily carried and concealed in the waistband by including a smooth handle surface. The smooth grip handle allows it to be easily placed in and withdrawn from the waistband with minimum friction to keep the baton from grabbing clothing and possibly becoming visible during certain activities. In the preferred embodiment, the handle is coated with a textured paint which provides a firm gripping surface for use while still permitting easy storage. Unlike a knurled or rough surface, the textured paint will not abrade or snag clothing and permits easy removal of the baton.

Further, the handle coated with textured paint has a lower friction coefficient than the knurled handles and allows the concealed baton to adjust during movement thereby allowing the baton to "move" with the wearer when appropriate or necessary for comfort.

In addition to the key ring mechanism and smooth handle, the concealed expandable baton may be made of dissimilar materials permitting the baton to be lighter in weight while at the same time maintaining the durability and strike force capability of the baton. In the preferred embodiment of the invention, the handle section and any intermediate sections are made of a lightweight durable material such as aluminum. However, it will be readily recognized that other lightweight materials such as wound composites, carbon fibers and the like could also be used. The outermost baton section is made from a hardened steel material which has the same mass and function as the tip section of prior art batons. By placing the heavy mass at the outer end of the baton, the strike force capability of the baton is maintained virtually unchanged from the heavier prior art batons. Thus, the subject invention provides a durable, lightweight baton which meets strike force objectives and may be easily carried and concealed. A baton of dissimilar materials is shown and described in my co-pending U.S. patent application Ser. No. 08/002,282, now U.S. Pat. No. 5,356,139, which is incorporated by reference herein.

The expandable baton of the preferred embodiment may also include a locking means for locking the telescoping sections in place once the baton has been whipped into the extended position. In the preferred embodiment, a button detent lock system is shown and described in my U.S. Pat. No. 5,149,092, incorporated by reference herein. Where desired, other locking systems, such as a friction lock system, could be substituted for the button detent lock system while still incorporating the combination of lightweight and heavy materials to meet weight and balance objectives.

The preferred embodiment of the subject invention may also include a uniquely designed removable tip and interchangeable tips for use with the expandable baton as shown in my co-pending U.S. patent application Ser. No. 08/315,114, which is a divisional of U.S. patent application Ser. No. 08/129,901, now U.S. Pat. No. 5,407,197, incorporated by reference herein. The removable tip of the preferred embodiment has a top section and threaded shaft and is threadably secured to the telescoping end of the baton. In the preferred embodiment, two circumferential resilient members, such as by way of example, O-rings, are used to provide resistance throughout the tip for preventing the tip from working its way out after repeated use and separating from the baton. The first O-ring is positioned at the top of the shaft and creates an area of initial resistance. The second O-ring is applied at the base of the shaft to provide increased resistance throughout the threaded area of the tip. The use of a secondary O-ring, which interferes with the major diameter of either the male or female mating thread, provides enough resistance to cause the threads to become self-locking when the tip is installed. Further, use of a secondary O-ring is cost effective, easily repaired and allows the tip to be installed and removed a number of times.

The standard button tip is of a mushroom shape and typically may be removed and replaced with interchangeable tips, such as an elongated cylindrical, wand-style search tip, a magnetic standard button tip or a magnetic wand-style tip. Each of the interchangeable tips is designed to prevent accidently separation from the baton and may include either one or two O-rings, as described above.

Therefore, it is an object and feature of the subject invention to provide a lightweight, concealable, full size, expandable baton having a non-identifying element such as a key ring for providing ready access to and retrieval of the expandable baton.

It is also an object and feature of the subject invention to provide an expandable baton having a smooth handle adapted for easy placement and removal from the waistband and including a firm gripping surface which will not abrade clothing.

It is a further object and feature of the subject invention to provide a detachable key ring mechanism at the end of the baton handle including a swivel which does not protrude beyond the end of the handle when the key ring is removed.

It is yet another object and feature of the subject invention to provide an expandable baton in which the handle section and any intermediate sections are made of a lightweight material while the outermost telescoping section is made of a heavy material for providing a lightweight baton while maintaining the strike force.

It is a further object and feature of the subject invention to provide a lightweight, concealed, expandable baton with a locking means for locking the baton in an extended position.

It is also an object and feature of the subject invention to provide a lightweight, concealed, expandable baton with a removable tip having a design which prevents the tip from accidently disengaging from the baton, particularly after repeated uses.

It is yet another object and feature of the subject invention to provide interchangeable tips having a design which prevents the tip from accidently disengaging from the baton, particularly after repeated uses.

DETAILED DESCRIPTION OF THE DRAWINGS

Figures 1, 2, 3, 4, 5:
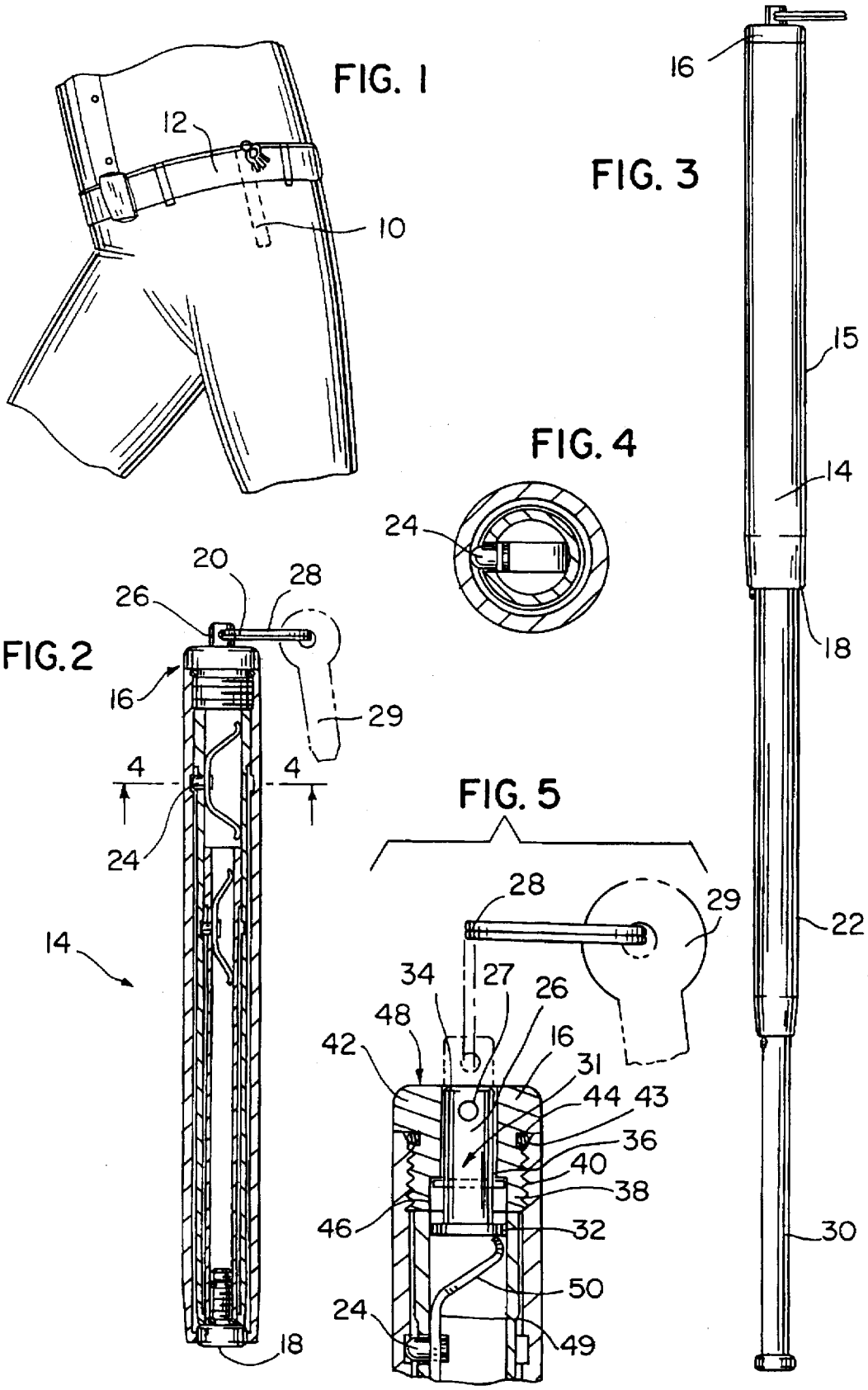
FIG. 1 is an illustration showing the concealable, expandable baton in its concealed position as carried within the waistband of an undercover law enforcement officer.
FIG. 2 is a cross-sectional view of the concealable, expandable baton in a collapsed position showing the locking means and swivel mechanism for attaching an element, such as a key ring.
FIG. 3 is a perspective view of the concealable, expandable baton in its extended position.
FIG. 4 is a cross-sectional view taken along line 4—4 of FIG. 2 showing the detent locking means.
FIG. 5 is a cross-sectional view of the capped end of the baton showing the detachable mechanism, movement of the swivel member and the detachable key ring.

The concealable expandable baton 10 of the subject invention is a lightweight, full size, expandable baton for use as an intermediate force weapon by undercover law enforcement personnel, the baton being capable of being well concealed in a non-identifying manner while at the same time being readily accessible for quick deployment. As shown in FIG. 1, the concealable baton 10 is carried and concealed within the waistband 12 of the undercover officer's clothing. The concealable baton 10 generally comprises a hollow handle 14 having a smooth outer surface 15, a capped end 16 and an open end 18, a detachable mechanism 20 extending from the capped end, at least one telescoping baton section 22 nested within the handle and a locking means 24 for locking the baton sections in an extended position.

The diameter and length of the handle 14 is sized to be comfortably carried within the waistband 12. In the preferred embodiment, the diameter of the handle is ⅞ inches and its length is 7 inches. The smooth outer surface 15 of the handle 14 allows it to be easily placed in and withdrawn from the waistband 12. In the preferred embodiment, the handle 14 is coated with a textured paint such as, by way of example epoxy powdered paint, to provide a firm gripping surface. While the use of textured paint provides a firm gripping surface, unlike a knurled or rough surface, the textured paint will not abrade or snag clothing and allows the baton to adjust during movement as necessary or appropriate for the comfort of the undercover officer.

As shown in FIGS. 2 and 5, the capped end 16 of the handle 14 includes the detachable non-identifying mechanism 20. The detachable mechanism 20 remains exposed and may hang over the waistband 12, as shown, to prevent the concealable expandable baton from falling into the clothing. In addition, the detachable mechanism 20 provides a means for grasping and quickly retrieving the baton 10 from its concealed position. In the preferred embodiment, the detachable mechanism includes a swivel member 26 having a through hole 27 for attaching an element, such as a key ring 28 and at least one key 29. As best seen in FIG. 5, the swivel member 26 is comprises an elongated, cylindrical shaft 31 having an enlarged base 32. The hole 26 is positioned adjacent to outer tip end 34 of the shaft. The baton cap 16 has a cylindrical through channel 36 adapted for rotatably receiving the shaft 31. In the preferred embodiment, the cap 16 has a threaded body 38 which is threadably received and engaged in the threaded end 40 of the baton handle.

The cap typically has an enlarged head 42 with an outer perimeter substantially equal to the outer perimeter of the baton handle, to provide a smooth, continuous surface. An annular recess 43 may be provided in the end of the handle for accommodating a resilient member such as the O-ring 44, providing a resilient locking element to assure that the cap stays in position relative to the baton handle. The through channel 36 at the lower open end 46 of the cap is enlarged to receive the base 32 of the swivel shaft, permitting the swivel to move to the extended position shown in phantom in FIG. 5. In the preferred embodiment, the inner diameter of end 46 matches the inner diameter of the first telescoping section 18, to provide a smooth transition surface permitting the swivel shaft to move freely between the extended (phantom) position and the retracted position.

In the preferred embodiment, when the swivel is fully retracted, the tip 34 is flush with the outer surface 48 of the cap. As illustrated, one leg 50 of the spring 49 of the button lock 24 serves as a positive stop for the swivel 26 when the baton is fully retracted. Of course, other positive stops may be employed within the teachings of those who are ordinarily skilled in the art. When the ring 28 is installed in the hole 27, the ring assures that the swivel will not fall through the cap, even when the baton is fully expanded, as in FIG. 3. In the preferred embodiment, the cap 16 of the handle 14 is dimensioned such that the swivel 26 does not extend beyond the capped end 16 when the detachable key ring 28 is removed and the member 26 is in its retracted position.

As shown in FIG. 1, when a key ring and keys are attached to the swivel member 26, the keys are positioned so that they hang over the waistband 12 in a nonsuspicious manner and provide a readily accessible means for grasping and quickly drawing the concealed baton 10 to an at ready position.

In the preferred embodiment, the concealable, expandable baton 10 of the subject invention is made of dissimilar materials as shown and described in my co-pending U.S. patent application Ser. No. 08/002,282, now U.S. Pat. No. 5,356,139, incorporated by reference herein. The use of dissimilar materials permits the concealable baton 10 to be lightweight while maintaining the durability and strike force capability of a heavier baton. In the preferred embodiment, the handle 14 is made from a lightweight, durable material, such as aluminum and the outermost baton section 30 is made from a heavier material, such as a hardened steel material, which has the same mass and function as the tip section of prior art batons. While placing the heavy mass at the outer end 30 effectively maintains the strike force capability of the baton, the baton 10 is lightweight and may be easily carried and concealed.

By grasping the keys, the concealable, expandable baton 10 may be quickly retrieved and whipped into an extended position (as seen in FIG. 3) for use as an intermediate force weapon. The baton 10 of the subject invention includes a locking means for securing the baton in the extended position. The swivel, key ring, key assembly also permits the baton to be held by the keys as a handle, permitting the baton to pivot as swung, increasing its versatility as an intermediate force weapon.

As shown in FIGS. 2 and 4, the preferred embodiment of the subject invention utilizes the button detent lock system shown and described in my U.S. Pat. No. 5,149,092, incorporated by reference herein. While a button detent system is utilized in the preferred embodiment, other locking means such as a friction lock system or a tapered lock system, as shown and described in my co-pending U.S. patent application Ser. No. 08/100,873 now U.S. Pat. No. 5,348,297, may be used.

In addition, the preferred embodiment of the subject invention may include a unique removable tip and interchangeable tips (not shown). The removable tip is uniquely designed to provide resistance throughout the tip for preventing the tip from working its way out after repeated use and separating from the baton. Because the tip is removable, interchangeable tips can be substituted to modify the baton for different uses. The interchangeable tips and unique design of the removable tip are shown and described in my co-pending U.S. patent application Ser. No. 08/315,114, which is a divisional of U.S. Pat. No. 08/129,901, now U.S. Pat. No. 5,407,197 incorporated by reference herein.

While specific embodiments and features of the invention have been disclosed herein, it will be readily understood that the invention encompasses all enhancements and modifications within the scope and spirit of the following claims.

What is claimed is:

1. A concealable, expandable baton for use as an intermediate force weapon by undercover law enforcement personnel, the baton adapted to be carried and concealed inside and quickly withdrawn from a waistband of clothing, the baton comprising:

a. a hollow handle having an inner peripheral wall, a capped end, an open outer end and a low friction outer surface, said handle having a diameter and length which is sized to fit comfortably within the waistband of the clothing;

b. a swivel member rotatably mounted in the capped end of the baton, said member having a through hole and being movable between a raised position extending beyond the capped end and a retracted position whereby the swivel member rests in the baton and does not extend beyond the capped end of the baton;

c. a detachable element attached to the swivel mechanism, said element adapted to hang over the waistband thereby preventing the baton from falling into the clothing and allowing the baton to be retrieved by grasping the element;

d. at least two telescoping baton sections, said telescoping baton sections having an outer peripheral wall and being axially movable between a retracted and extended position, wherein said telescoping baton sections are housed within the handle when the baton sections are in the retracted position and are releasably outward from the open outer end of the handle and selectively locked in the extended position; and e. a locking means for locking the telescoping sections in the extended position.

2. The concealable baton of claim 1, wherein the detachable element is a key ring, said key ring adapted for carrying at least one key whereby said key ring is visible and adapted for positioning the key to hang over the waistband thereby preventing the baton from falling into the clothing and allowing the baton to be quickly retrieved by grasping the key attached to the key ring.

3. The concealable baton of claim 1, wherein the outer surface of the handle is smooth to permit movement between clothing and the baton.

4. The concealable baton of claim 3, wherein the surface is coated with a textured paint.

5. The concealable baton of claim 4, wherein the telescoping baton sections have opposite ends, an outer end and an inner end, the inner end always being contained in an adjacent receiving baton section in both the expanded and retracted positions, the outer end further including an internally threaded bore for receiving a removable tip.

6. The concealable baton of claim 1, wherein said handle is constructed of a first material having a first specific weight and a first hardness and said telescoping baton sections having opposite ends, an outer end and an inner end, the inner end always being contained in an adjacent receiving baton section in both the expanded and retracted positions, at least a portion of one of said telescoping baton sections being constructed of a second material having a second specific weight and a second hardness which is different from the first material.

7. The concealable baton of claim 1, wherein said handle is constructed of a first material having a first specific weight and a first hardness and at least one of said telescoping baton sections being constructed of a second material having a second specific weight and second hardness which is different from the first material.

8. The concealable baton of claim 1, wherein the locking means comprises a positive stop for limiting the axial movement of the telescoping sections relative to the handle when in the extended position, a locking device movable between a first, locked position and a second, unlocked position for selectively locking the telescoping sections in one of the extended and retracted positions, and an annular channel in the inner peripheral wall of the handle.

9. The concealable baton of claim 8, wherein said positive stop is adapted for engaging a portion of the inner peripheral wall of the handle with a portion of the outer peripheral wall of the telescoping sections in a noninterfering relationship for maintaining axial alignment of the handle and the telescoping sections and wherein said annular channel is adapted for receiving the locking device for locking the telescoping sections in a retracted position.

10. The concealable baton of claim 9, wherein said positive stop is adapted for defining an abutting surface against the swivel member when the telescoping sections are in the retracted position.

11. The concealable baton of claim 1, wherein said swivel member comprises a cylindrical shaft having an outer end and an inner end, said outer end including a tip end having a through hole for attaching the detachable element and said inner end having an enlarged base, said cylindrical shaft retained in the capped end of the baton.

12. The concealable baton of claim 11, wherein said detachable element is a key ring.

13. The concealable baton of claim 11, the capped end of the baton further including a cap comprising:

a. an enlarged head having a diameter substantially equal to the diameter of the handle for defining a smooth, continuous surface;

b. a threaded body adapted to be threadably mounted to the handle; and c. a cylindrical channel extending through the head and the body and being adapted for rotatably receiving the cylindrical shaft, said channel having an upper end and a lower end, said lower end being adapted to receive the enlarged base of the shaft.

* * * * *